United States Patent [19]

Parups

[11] 4,051,957

[45] Oct. 4, 1977

[54] CONTAINER LOADING SYSTEM

[75] Inventor: Eriks Parups, Bradenton, Fla.

[73] Assignee: Pitney-Bowes, Inc., Stamford, Conn.

[21] Appl. No.: 698,863

[22] Filed: June 23, 1976

Related U.S. Application Data

[63] Continuation-in-part of Ser. No. 542,665, Jan. 21, 1975, abandoned.

[51] Int. Cl.[2] ..... B65G 57/14; B65H 29/18

[52] U.S. Cl. ..... 214/6 H; 214/6 C; 271/64; 271/80; 271/176; 271/184; 271/217

[58] Field of Search ..... 214/6 H, 6 D, 6 C; 271/64, 69, 80, 163, 176, 184, 199, 217

[56] References Cited

U.S. PATENT DOCUMENTS

| | | | |
|---|---|---|---|
| 2,613,824 | 10/1952 | Tallman | 214/6 C X |
| 2,631,039 | 3/1953 | Barber | 271/80 X |
| 2,813,637 | 11/1957 | Perry et al. | 214/6 H X |
| 3,061,304 | 10/1962 | Smith | 271/163 X |
| 3,420,520 | 1/1969 | Wiegert et al. | 271/199 |
| 3,430,950 | 3/1969 | Marsh et al. | 271/64 |
| 3,469,836 | 9/1969 | Javid | 271/199 X |
| 3,507,492 | 4/1970 | Spencer | 271/199 X |
| 3,729,188 | 4/1973 | Stephenson | 271/64 |

*Primary Examiner*—L. J. Paperner

*Attorney, Agent, or Firm*—Robert S. Salzman; William D. Soltow, Jr.; Albert W. Scribner

[57] ABSTRACT

A system for automatically loading mail into a postal tray. A tray support mechanism holds a postal tray at a steep angle at each of two loading stations within the system. A transport system conveys articles of mail to one of the two stations where each piece of mail is ejected laterally into the tray. The tray is gradually moved downward as it is filled. When completely filled, a changeover mechanism begins to fill the tray at the other station while the filled tray is removed and replaced.

26 Claims, 16 Drawing Figures

254
256
58a
10
140a
10
326
134a
138a
144
54a
104a
110a
140a
246a
142b
88a
100a
20a
52a
50a
18
22
246a
294a
322
324
298
292a
54a
104a
110a
316
318
58a
104b
54b
312
310
320
314
246b
308
16
20b
52b
50b
246b
294b
148
146
188
104b
54b
150
142a
140b
138
182
292b
174
188
12a
140b
328
134b 11
246a
248a
228a
54a
18
240a
166
234a
250a
242a
230a
T
16
292a
222a
236a
48a
298
22
294a
22
266a
24
306a
278a
148
170
280
138a
146
272a
178
168
E
134a
108a
218a
322
176
106a
56a
55a
136a
128a
66a
68a
90a
96a
70a
72a
74a
120a
62a
104a
78a
94a
80a
114a
86a
82a
76a
118a
88a
84a
124a
116a
60a
94a
20a
102a
58a
98a
42a
40a
36a
54a
26
34a
28
38a
44a
30
32
46a

CONTAINER LOADING SYSTEM

CROSS-REFERENCES TO RELATED APPLICATIONS

This is a continuation in part of U.S. application Ser. No. 542,665 filed Jan. 21, 1975, now abandoned.

BACKGROUND OF THE INVENTION

In post offices and businesses handling large quantities of mail, it is customary to transport the mail in large plastic trays. These trays are hand-loaded. This hand-loading is awkward and consumes a substantial amount of time. Furthermore, it is not unusual to spill mail in the process of loading. Accordingly, it is a primary object of the present invention to provide a system to automatically load articles into a container and, more specifically, to load mail into a tray. Other objects are to provide such a system which is easy to operate, which can operate continuously, and which is adjustable as to container size. Other objects, features and advantages will be apparent from the following description and appended claims.

SUMMARY OF THE INVENTION

A system for loading articles into an open container comprising a main frame and means on the frame for transporting articles sequentially to one of two loading stations. An open top container is supported at a relatively steep angle with its open top adjacent and facing each loading station. Each loading station includes means for ejecting each of the articles for the transporting means into each container and a sensor responsive to the arrival of each article to actuate the ejector means. Other means are provided for lowering the container to sequentially receive articles stacked therein. Each container is supported on a mechanism, which allows for their easy removal, and which signals when each container is full. The full container signal (at each station) is coupled to a switching means for providing an alternate feed to each of the loading stations. When a first station becomes filled, the articles are directed to the second of the two stations. The first station container is emptied, and the second station container is allowed to fill. When the second station container is full, the switching means redirects the articles to again feed to the first station.

DESCRIPTION OF THE PREFERRED EMBODIMENT

Figure 1:
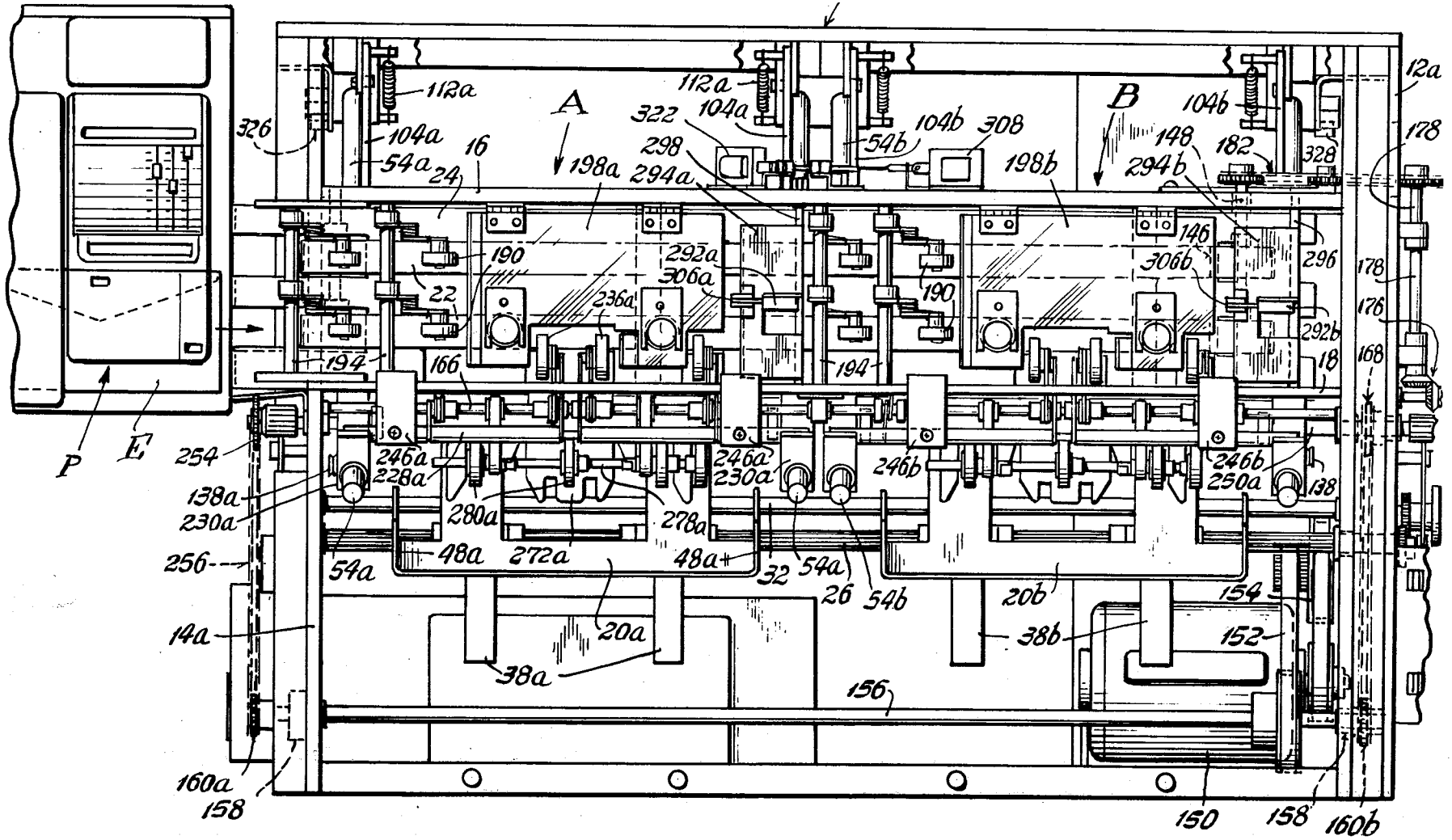
FIG. 1 is a plan view of a machine constructed in accordance with the invention shown in FIG. 1*a;*
Figure 1A:
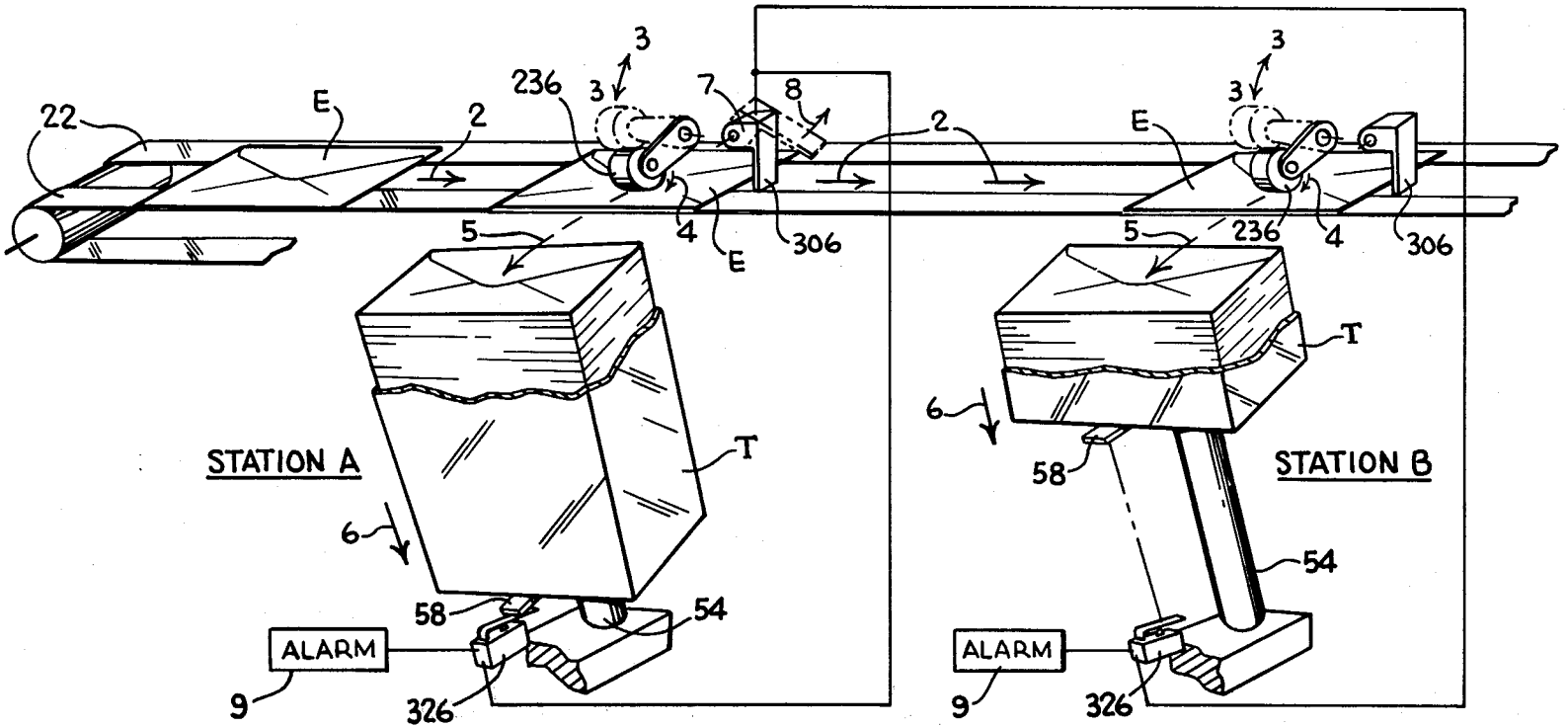
FIG. 1*a* is a schematic perspective view of the inventive system.

The system of the invention is shown in the schematic perspective view of FIG. 1*a.* A conveying mechanism depicts a pair of endless belts 22 for conveying envelopes E (or other articles) along a generally straight feed path generally shown by arrows 2. The envelopes are transported along the feed path in seriatim (sequentially).

There are two loading stations A and B, respectively, disposed along the feed path of the conveyor. As illustrated, station B is downstream from station A. Each station has a limiting arm 306, which will stop each envelope E. Each station also has a rotating (arrow 4) ejector wheel 236, which engages (arrows 3) each stopped envelope. The rotating ejector wheel 236 ejects (arrow 5) each envelope to an inclined open container (tray T). Each container T is removable and is supported on a guide rod 54. As the containers fill up with envelopes, they are caused to move downwardly (arrow 6) upon the guide rod 54. The container supporting block 58 comes into engagement with switch 326, when the container becomes filled with envelopes. Switches 326 are each connected to a disabling/enabling mechanism 7, that is operatively attached to the limiting arm 306 at station A.

When the container T at station A is full, the switch 326 (station A) is caused to close. A "full container" signal is sent to the disabling/enabling mechanism 7. Mechanism 7 is activated and causes limiting arm 306 to move out of the envelope stopping position as illustrated by arrow 8. The envelopes are now conveyed to station B.

During the time that the envelopes are filling the container T at station B, the container T at station A is emptied. When the container is full at station B, the switch 326 (station B) activates mechanism 7 to move arm 306 (station A) back to the envelope stop position. Container T at station B is now emptied, while the station A container is caused to fill.

Thus, it is seen that the stopping arm 306 at station A is alternately enabled and disabled to allow feeding to each station in turn.

In the event that an operator fails to empty the containers T, such that both switches 326 are closed, the conveyor may be disabled to prevent the continued feeding of envelopes E.

Each switch 326 may be provided with an indicator 9 (alarm) to remind the operator when to empty the filled containers.

The ejector wheel 236 is caused to activate (eject the envelopes) when an envelope is sensed at limiting arm 306. A sensor or switch may be built into each arm 306 for this purpose, or a separate sensing unit can be used.

A further understanding of the overall format of the machine of this invention may be best derived from FIGS. 1–4, which illustrate the machine positioned to receive mail from a postage meter P. The machine comprises a main frame 10 carrying right end wall members 12*a, b, c* and left end wall members 14*a, b.* Extending horizontally along the top of the structure are spaced vertical wall members 16, 18. The machine of this invention is designed with two loading stations designated by the letters A and B in FIG. 1. However, the machine could have any number of such loading stations as will become apparent from the detailed description to follow.

Figure 3:
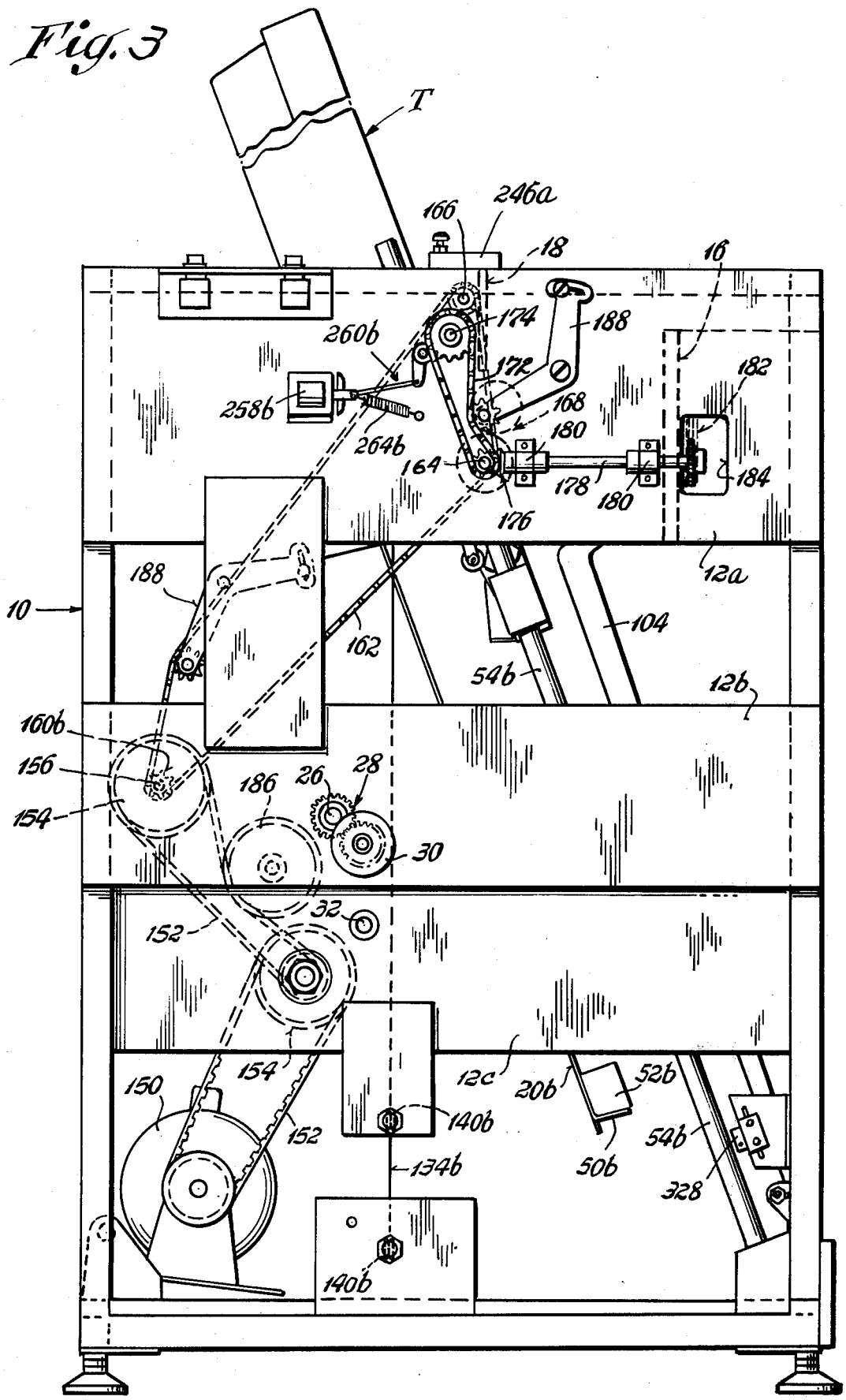
FIG. 3 is a right end view of the machine of FIG. 1.
Figure 4:
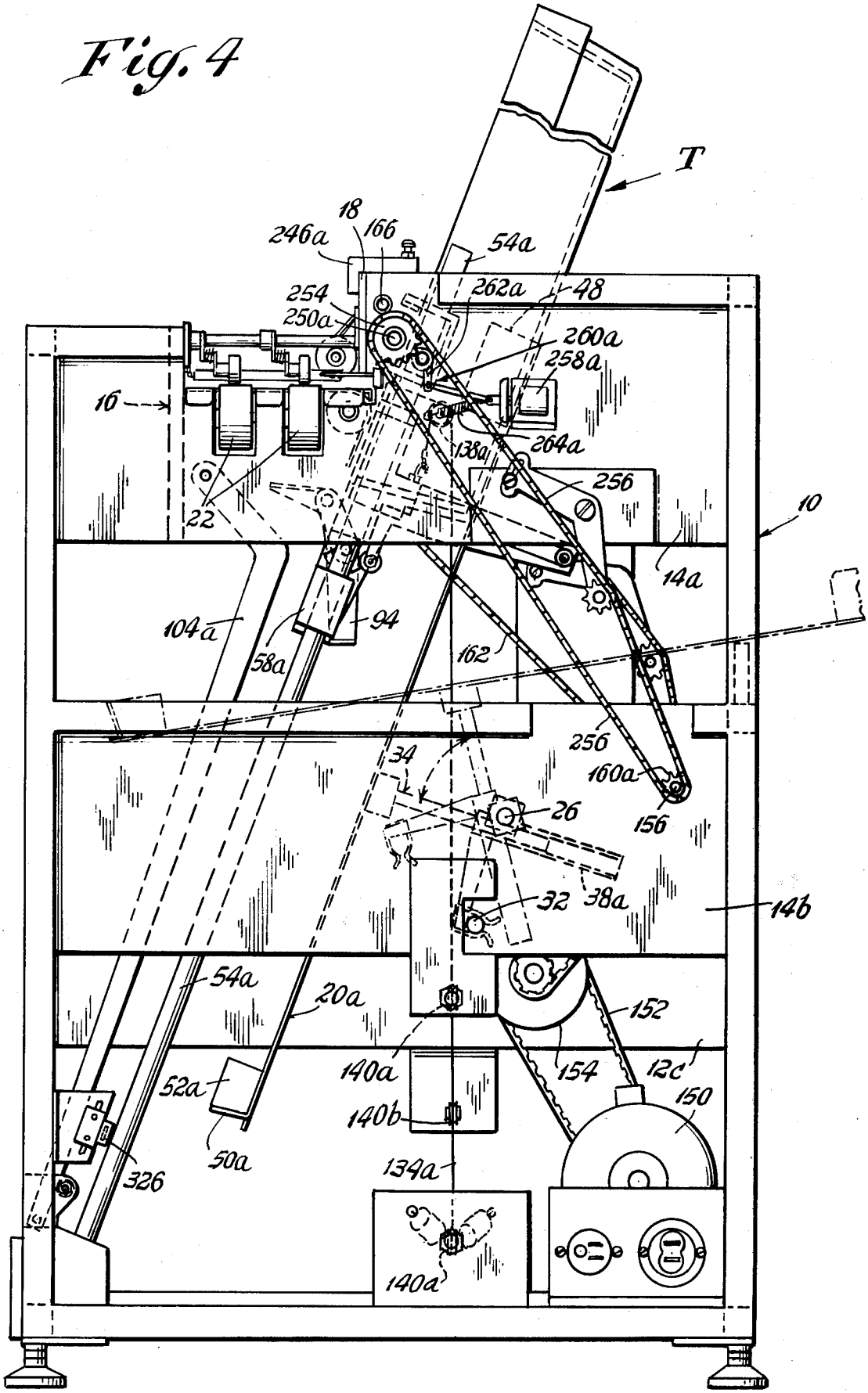
FIG. 4 is a left end view of the machine of FIG. 1.

The illustrated machine has four major mechanical sub-groups. These may be defined as the tray support mechanism, the transport mechanism, the tray loading mechanism and the changeover mechanism. Each will be described in detail below. Generalizing, the tray support mechanism includes a tray support rack 20 (20*a* or 20*b* at each station A and B). These are normally positioned at a steep vertical angle as shown in FIGS. 3 and 4 and slidably receive a conventional plastic mail tray T. The empty tray is positioned at the top of the rack 20 as shown in FIG. 4.

The transport mechanism comprises a pair of endless belts 22 which are driven over a bed plate 24 to move incoming mail to either of loading stations A or B.

As each piece of mail arrives at the loading station in use, an ejector mechanism ejects the piece from the transport belt and into the tray T and tamps it firmly against any preceding stacked pieces. This tamping action causes the tray to be driven downwardly along the support rack 20 by means of a ratchet-like mechanism.

When the filled tray reaches the bottom of the tray support rack, it actuates the changeover mechanism. This mechanism diverts the mail from the station having the filled tray to the station having the empty tray. Thereafter, the filled tray may be removed by the operator.

The various mechanical sub-groups briefly set forth above will now be described in detail. Only one tray support and tray loading mechanism will be described as those in each loading station are substantial duplicates. However, in the drawings, numerals referring to duplicated parts in stations "A" and "B" will have the letters "*a*" and "*b*", respectively, appended thereto.

TRAY SUPPORT MECHANISM

A splined shaft 26 extends the length of the machine and is supported by bearings in end wall members 12*b*, 14*b* (FIGS. 3, 4). At the right end the shaft 26 is connected by means of a gear train 28 to an external adjusting knob 30. Mounted in the same end walls and slightly below the splined shaft 26 is a smooth locking shaft 32. Adjacent each of the loading stations a pair of parallel support rods 34 are secured in spaced relationship to the splined shaft 26 in the manner shown in FIG. 5. A horizontal bearing block 36, having a smooth cylindrical inner surface, is mounted on the splined shaft so as to be rotatable thereabout. Extending perpendicular to the bearing block 36 is a support cylinder 38. The cylinder 38 slidingly supports the rod 34 which has gear teeth milled along its surface to form a rack gear 40 which meshes with the splined shaft 26. The rod 34 is secured to the tray support rack 20 by a threaded connector 42. Extending downwardly from the cylinder 38 is a locking arm 44 which carries at its end a spring clip 46 which engages the locking shaft 32, thereby holding the rod 34 and tray 20*a* in the position illustrated in FIG. 5. The tray support rack 20 is substantially planar but at its upper end is formed with side walls 48 for receiving the tray T therebetween. Similarly, the bottom end of the tray is formed with a perpendicularly extending shelf 50, upon which is mounted a resilient bumper block 52. The tray support rack 20 is normally immovable during operation, and the tray T slides along its upper surface in a controlled manner. The manner in which this is achieved will now be described.

Figure 5:
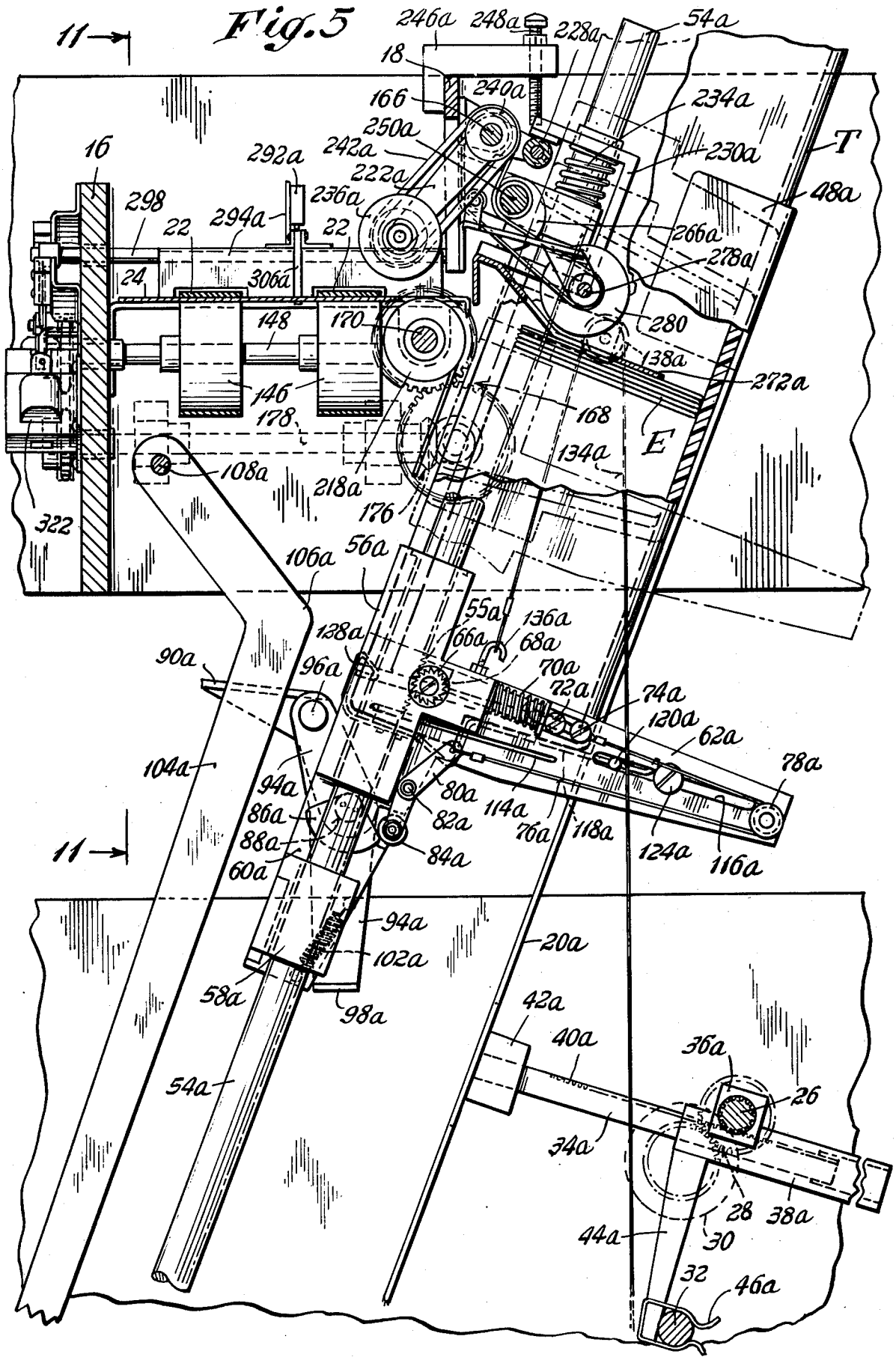
FIG. 5 is an enlarged detail illustrating a portion of the tray support mechanism of the invention.
Figure 6:
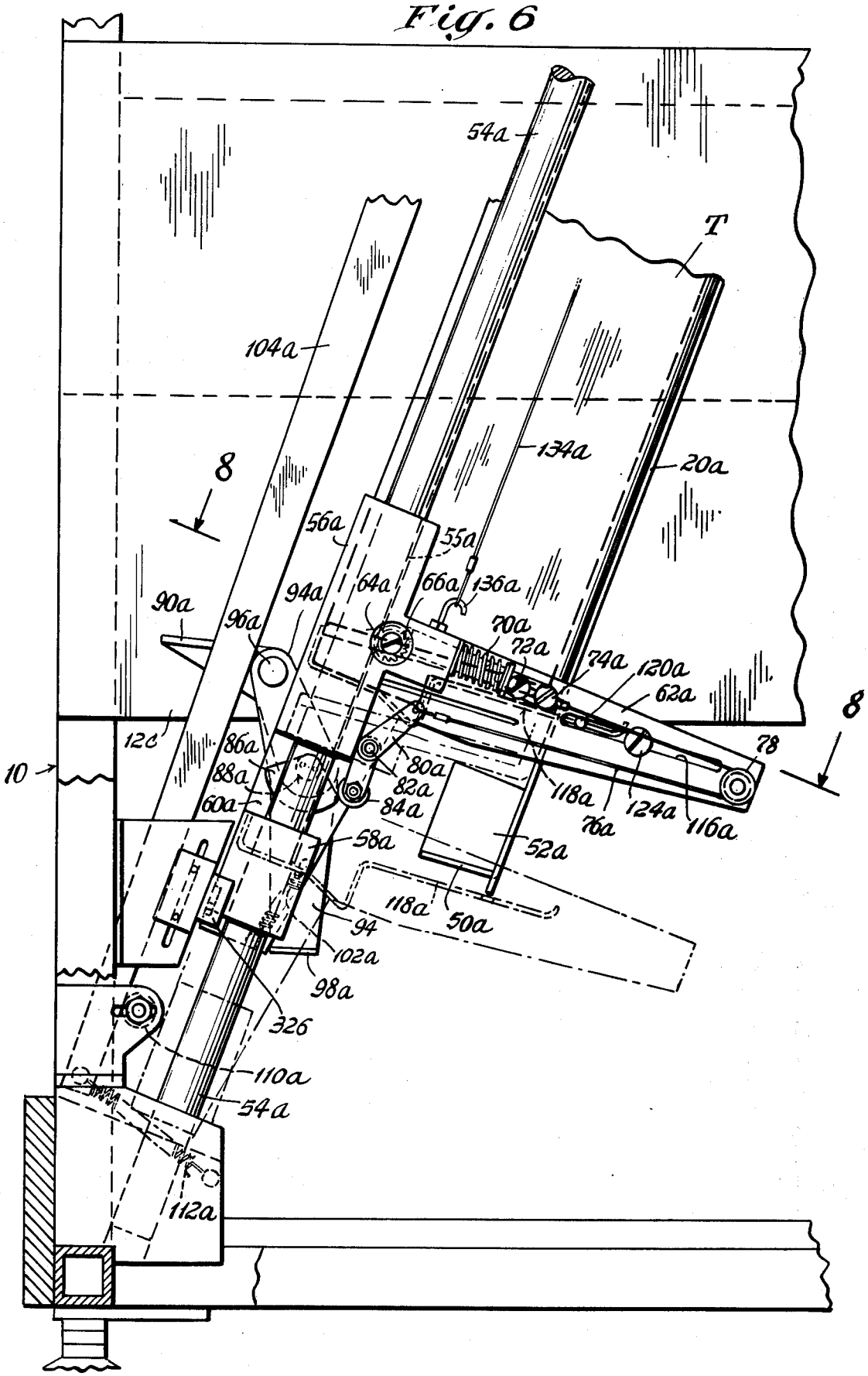
FIG. 6 is an enlarged detail illustrating the tray support mechanism in a different position.
Figure 7:
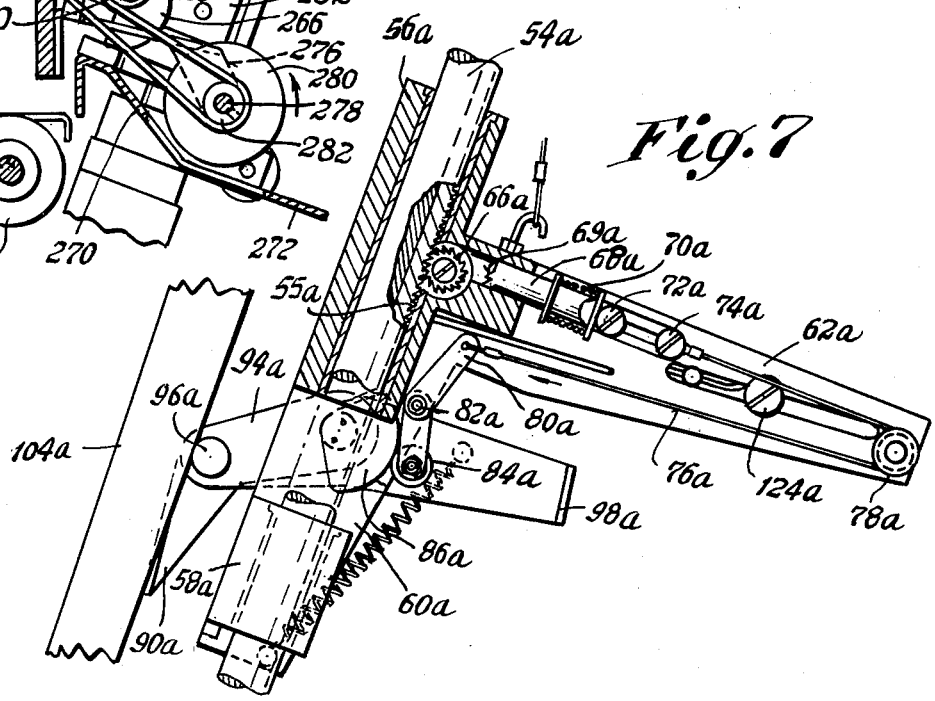
FIG. 7 is an enlarged view showing the operation of the tray release mechanism.
Figure 8:
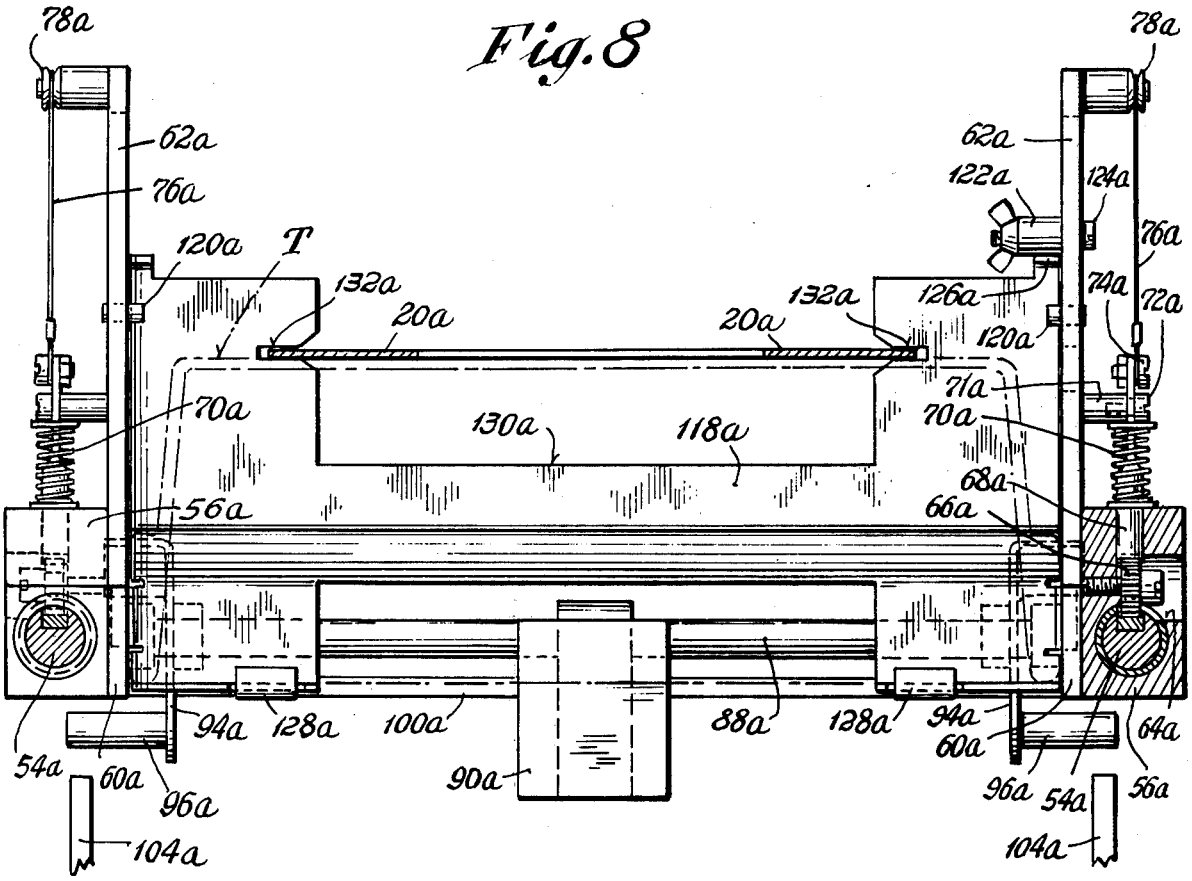
FIG. 8 is a cross section taken substantially along the line 8—8 of FIG. 6.
Figure 9:
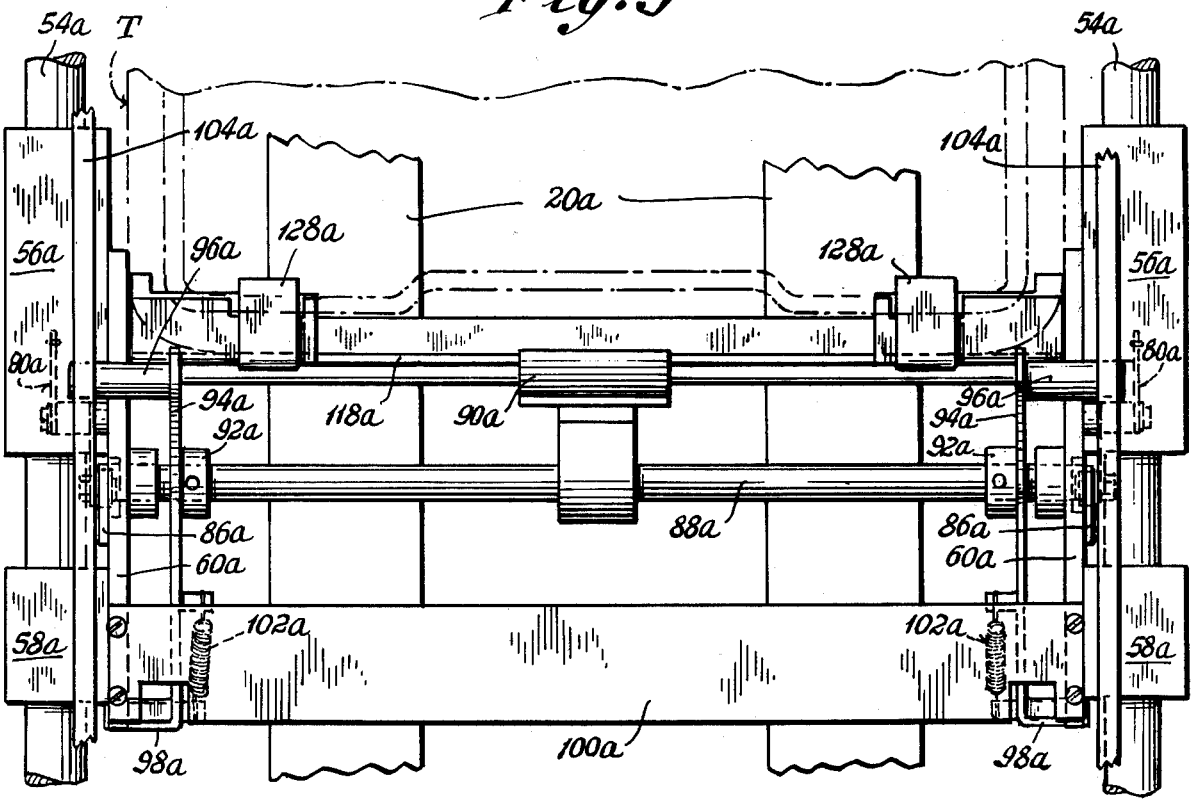
FIG. 9 is a back view of the mechanism of FIG. 8.

The main support for the tray is derived from a pair of vertically inclined guide rods 54 mounted in the frame 10 and disposed on opposite sides of each of the tray support racks 20. Each of the rods 54 is milled so as to carry a linear array of ratchet teeth 55 (FIG. 7). Mounted upon each of rods 54 is the assembly illustrated on FIGS. 5–9. This assembly comprises a pair of blocks 56, 58 slidably mounted on the rod 54 and secured to a plate 60 which includes a forwardly (to the right as viewed) extending arm 62. The block 56 is substantially T-shaped as shown in FIGS. 5–7 and includes a drilled recess 64 within which is rotatably mounted a circular ratchet gear 66 in meshing engagement with the linear ratchet gear 55 as shown in FIG. 7. The block 56 is also drilled to receive a detent 68 having pawls 69 engaging ratchet 66. The detent extends outwardly from the block 56 and is spring loaded into engagement with the gear 66 by a spring 70 which is secured to arm 62 by means of post 71 and screw 72. The external end of the detent 68 is secured by means of a bolt 74 to a wire 76. The wire 76 is wrapped around a pulley 78 and its other end is secured to one end of a lever 80 mounted on a pivot 82. The other end of lever 80 carries a roller 84 which serves as a cam rider riding on the surface of a cam 86. The cams 86 of each of the assemblies associated with a single tray support are mounted on opposite ends of a release rod 88 which is rotatably mounted between the plates 60 and carries a tray release pedal 90 at its mid-point. Secured to each end of the release rod 88 by a collar 92 and set screw is a double ended arm 94. The upper end of arm 94 carries a sidewardly extending rod 96 and the lower end is bent outwardly to form a limit stop 98 bearing against the lower end of the plate 60. The two sliding sub-assemblies associated with each of the tray support racks are further united by a horizontal tie member 100.

The arms 94 are spring loaded into the positions illustrated in FIGS. 5 and 6 by means of springs 102 connected between arms 94 and member 100. Mounted on the main frame and alongside each of the guide rods 54 is a drag bar 104. This bar extends substantially parallel to the guide rod 54 but is formed with a knee 106 near its upper end which is mounted to the main frame by means of a pivot 108. The lower end of drag bar 104 is spring loaded against a stop 110 by means of a spring 112 connecting it to the main frame.

Returning now to the arms 62, it will be noted that they each define a pair of substantially horizontal slots 114, 116. These slots serve to retain the ends of a tray support shelf 118. The tray support shelf 118 extends between the two arms 62, being supported therein by means of tabs extending into slots 114 and studs 120 extending into slots 116. The alignment of the shelf 118 is adjustable by means of a positioning post 122 (FIG. 8) carried in slot 116 by a screw 124 and bearing against a curved lip 126 on shelf 118. The shelf 118 is shaped to roughly conform to the end wall of a mail tray T and carries on its upper edge a pair of tray retaining spring clips 128. The shelf also has a cutout region 130, on each end of which is a slot 132, which loosely engages the edges of the fixed tray support rack 20. This tray support mechanism is movable along the guide rods 54 in a manner to be later described. The dimensions and relationships of the parts are such that, when the mechanism reaches its lowest position as shown by the dash-dot lines in FIG. 6, the slots 132 in the support shelf 118 no longer retain the rack 20. Furthermore, the mechanism is counterweighted by means of a wire 134 secured by means of a hook 136 to each of the arms 62 and extending upwardly over a pulley 138 and then downwardly around guide pulleys 140 (FIG. 2) to the end of a relatively heavy coil spring 142 secured to the main frame.

TRANSPORT MECHANISM

Figure 10:
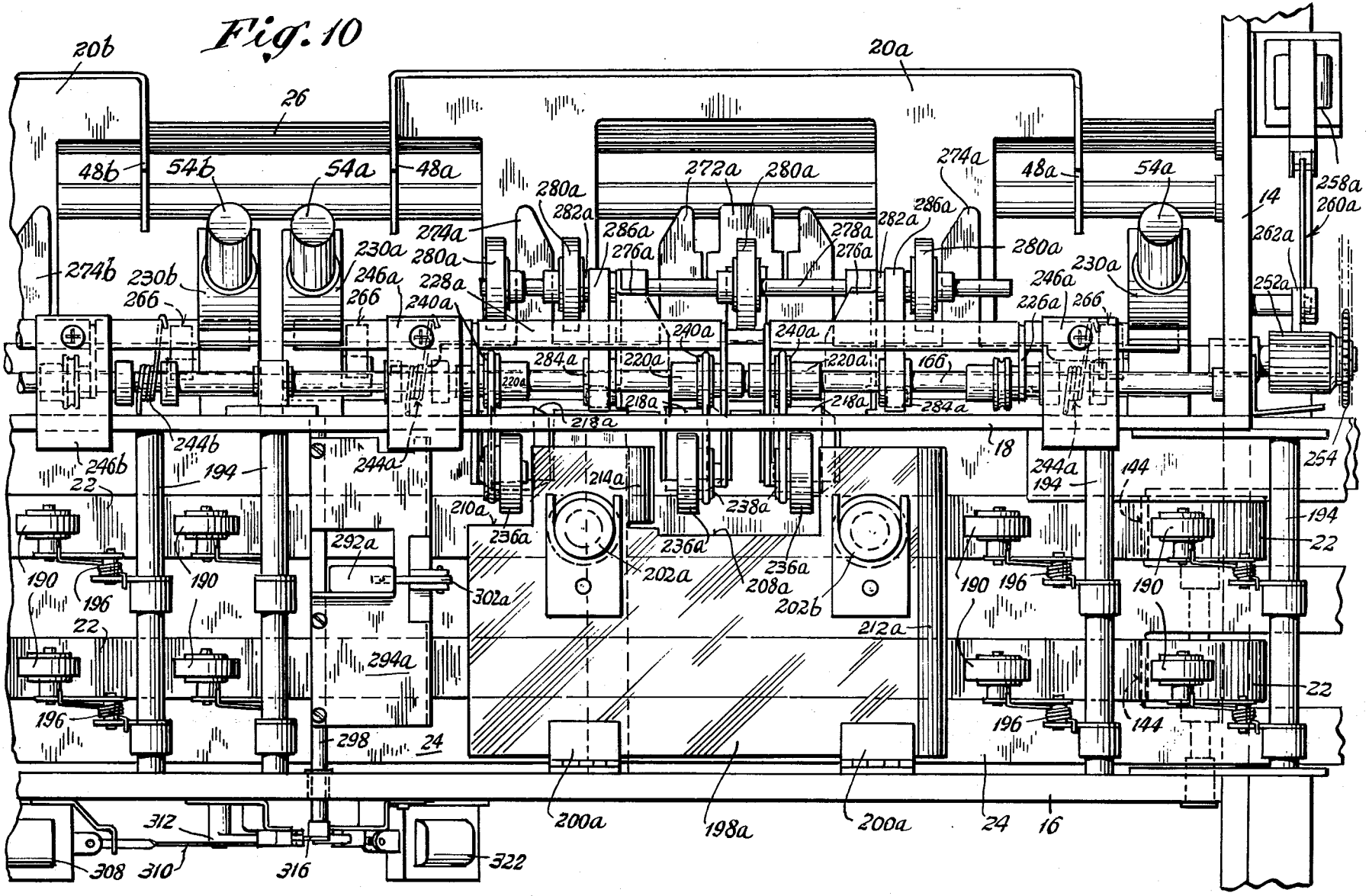
FIG. 10 is an enlarged plan view of one loading station of the machine of the invention.
Figure 11:
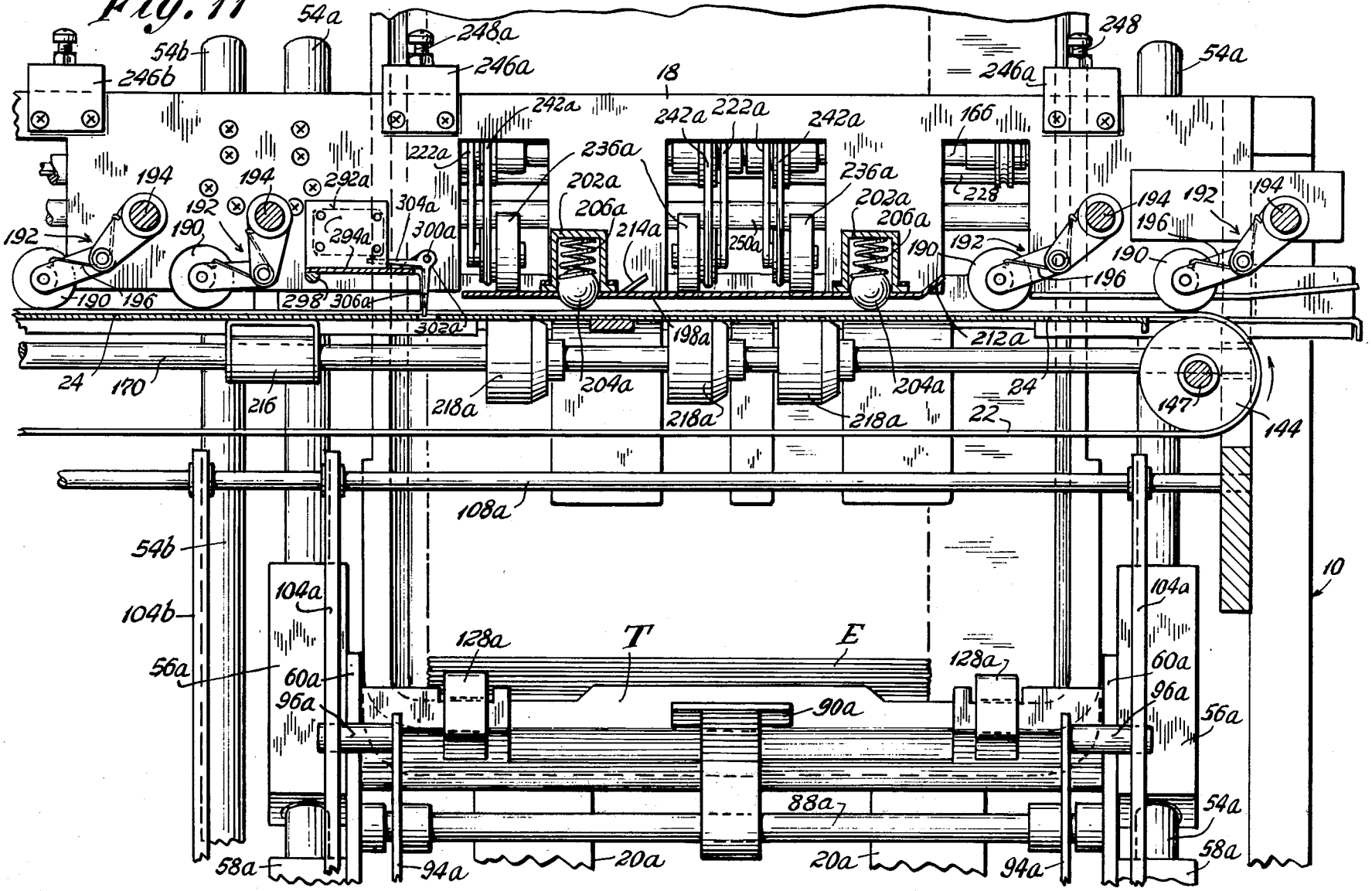
FIG. 11 is a cross section taken substantially along the line 11—11 of FIG. 5.

The transport mechanism is common to both loading stations of the machine and comprises the belts 22 previously referred to and shown most clearly in FIGS. 1, 10 and 11. These belts extend around idler pulleys 144 at the left end of the machine and over drive pulleys 146 at the right end of the machine. The idler pulleys are mounted on a shaft 147. The drive pulleys are mounted on a drive shaft 148 which extends through the vertical wall member 16.

The drive for the transport mechanism and for all other functions of the machine is derived from a single motor 150 shown in FIG. 3. By means of belts 152 and pulleys 154, the motor drives a shaft 156 supported by bearings 158 (FIG. 1) which extends the length of the machine and carries a sprocket 160*a* at its left end and a sprocket 160*b* at its right end. By means of a chain 162 (FIG. 3) and conventional sprockets, the motor is also caused to drive a stub shaft 164, an upper ejector drive shaft 166, by means of gear train 168 a lower ejector drive shaft 170 (FIG. 11), and by means of chain 172 a clutch mounted sprocket 174. By means of bevel gears 176, the stub shaft 164 also drives a belt drive shaft 178 mounted on wall member 12*a* by bearings 180. The drive pulley shaft 148 (FIG. 2) is driven by belt drive shaft 178 through sprockets and a chain 182 which extends through a suitable cutout 184 provided in wall member 12*a.* Proper tension is maintained on the belts and chains by means of conventional idler pulleys 186 and adjustable idler sprocket assemblies 188.

In addition to the transport belts 22, the transport mechanism also includes a plurality of spaced idler rollers 190. The rollers 190 are aligned along the upper surface of the belts 22 as illustrated in FIG. 10. They are individually mounted as shown in FIG. 11 on hinged arm assemblies 192 secured to support rods 194. The rollers are urged against the surface of the belts 22 by means of individual springs 196.

TRAY MECHANISM LOADING

The machine described herein includes two separate but substantially identical tray loading mechanisms, one associated with each loading station. Accordingly, only one such mechanism will be described herein — that associated with station A. Positioned above the belts 22 at each loading station is a transparent plastic plate 198 (FIGS. 10, 11). Plate 198 is connected to bed plate 24 by means of hinges 200. Mounted on the plate over the forwardmost of belts 22 are a pair of cylindrical housings 202. As shown in FIG. 11, each of these housings contains a ball bearing 204 which extends through an aperture in plate 198 which is slightly smaller than the diameter of the ball. The balls are loaded downwardly and against the aperture by means of coil springs 206. As will be apparent from FIG. 10, the plate 198 has a central substantially rectangular aperture 208 and a rectangular notch 210 at the inner "downstream" corner (as referenced to the direction of transport belts 22). The upstream-facing edges of the plate 198*a* are curved upwardly to form guideways 212, 214.

Mounted below the bed plate 24 is the lower ejector drive shaft 170 mounted on bearings 216. Mounted on this shaft for rotation thereiwth are three lower ejector friction wheels 218. As will be seen in FIG. 10, these wheels are aligned with the apertures 208, 210 in plate 198 and, as will be seen in FIG. 12, their upper edges are aligned approximately with the top surface of bed plate 24.

Figure 12:
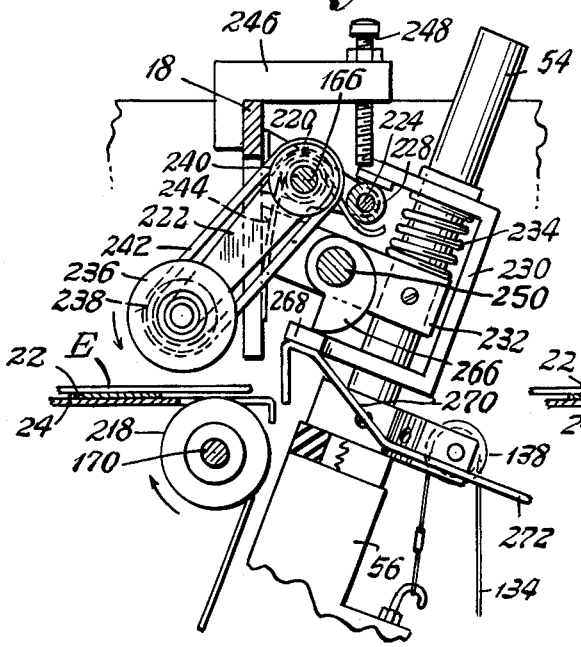
FIGS. 12–14 are enlarged detail drawings illustrating the operation of the tray loading mechanism.
Figure 13:
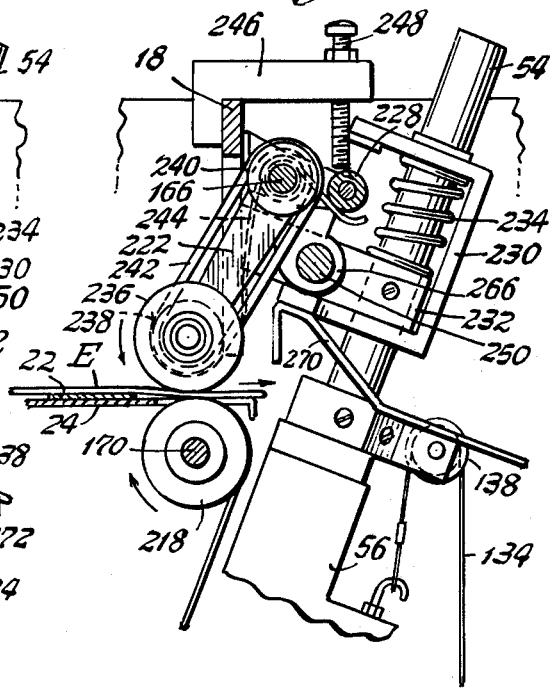

Mounted upon the shaft 166 at each loading station by means of bearings 220 are three L-shaped brackets 222. The brackets at each station are aligned and their shortest ends are interconnected by a tie rod 224 which is also connected to the shaft 166 by means of a radial arm 226. As will be apparent from FIG. 10, the rod 224 carries a plurality of spacer bushings 228 to maintain the spacing between the L-shaped brackets 222 and the radial arm 226. As will be further apparent from FIG. 10, the ends of this composite rod extend into C-shaped brackets 230 which are slidably mounted on the upper ends of guide rods 54. The upper ends of rods 54 are securely connected to the machine frame by means of supports 232 (FIGS. 12, 13). A compressed coil spring 234 applies force against the bracket 230 tending to slide it upwardly along the guide rod 54.

Carried on the longer end of each of the L-shaped brackets 222 is an upper ejector friction wheel 236 and pulley 238. Aligned with each of pulleys 238 and mounted on shaft 166 for rotation therewith is a drive pulley 240. Interconnecting each of drive pulleys 240 with its associated ejector wheel pulley 238 is a belt 242. As will be apparent from FIGS. 12 and 13, the assembly of the three L-shaped brackets 222 with their associated upper ejector wheels 236 and the tie rod 224 are biased in a counterclockwise direction by means of a pair of springs 244. However, they are normally maintained in the position illustrated in FIG. 12 by means of the bracket 230. Also associated with each of the loading stations are a pair of spaced brackets 246, each of which supports an adjustable bolt 248 for providing a limit stop to counterclockwise movement of the upper ejector wheel assembly as viewed in FIGS. 12 and 13.

Rotatably mounted between the spaced supports 232 of each loading station is a cam shaft 250 which extends outwardly through the left or right end wall of the machine to a one revolution clutch 252. The power drive to the clutch 252*a* is provided by a sprocket 254 and chain 256 (FIG. 4) from the sprocket 160*a* previously described. A similar drive for the clutch 252*b* is provided by the sprocket 174 (FIG. 3) previously described. Mounted on each end wall of the machine is a clutch actuating solenoid 258 which is connected to the clutch 252 by means of a suitable linkage 260 and pivot arm 262. The core of the solenoid is held normally withdrawn by means of a spring 264.

Figure 14:
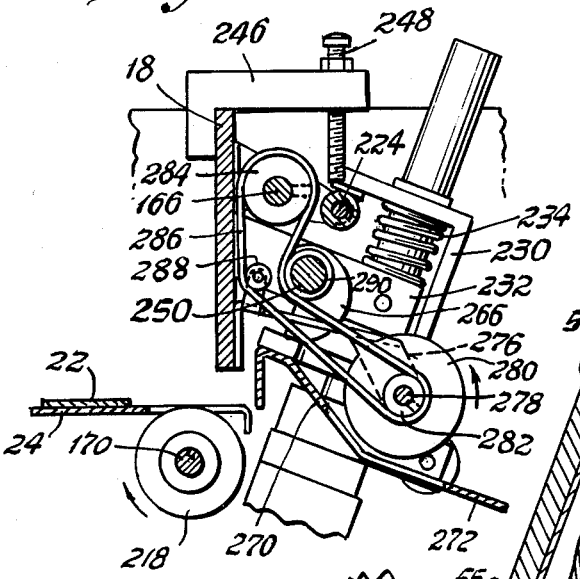

Mounted on the cam shaft 150 for rotation therewith are cams 266. Each cam is positioned within a different one of the brackets 230 as shown in FIGS. 12–14 and bears against a camming surface 268 of the bracket (FIG. 12). Secured to and extending between each pair of brackets 230 at each loading station is an elongated sheet metal guide plate 270 having central 272 and end 274 presser feet (FIG. 10). Mounted directly above the presser feed on brackets 276 (FIGS. 10, 14) is a horizontal shaft 278 upon which is mounted four stacker friction wheels 280. The shaft also carries a pair of pulleys 282 which are driven from aligned pulleys 284 on the upper ejector drive shaft 166 by means of belts 286. Each belt also passes under an idler roller 288 (FIG. 14)

and a bushing 290 on the cam shaft 250. The stacker wheels 280 are normally slightly above the presser feed 272, 274 as will be seen from FIG. 14. However, the feet are apertured and relieved as illustrated in FIG. 10 to receive the wheels upon vertical movement of the feet.

The actuation of the tray loading mechanism is initiated by a microswitch 292 mounted on a bracket 294 as shown in FIGS. 10, 11. The base of the bracket 294 is horizontal and extends across both transport belts 22. The bracket **294*b* of the second loading station is mounted on a fixed rod 296 (FIG. 1) supported between vertical wall members 16, 18. However, in the case of the first loading station, the bracket 294*a* is supported by a rotatable shaft 298 mounted between the same wall members. The shaft 298 extends through the wall member 16 for a purpose to be later described. Mounted at the forward end of each of the brackets 294 on a pivot 300 is an L-shaped plastic sensor arm 302 having a horizontal finger 304 which extends horizontally to lie against the actuating button of microswitch 292 and a vertically depending finger 306 which extends downwardly between the transport belts 22 and in the path of articles being carried thereby. Each of the microswitches 292 is connected to actuate its corresponding cam clutch solenoid 258**.

CHANGEOVER MECHANISM

Figure 2:
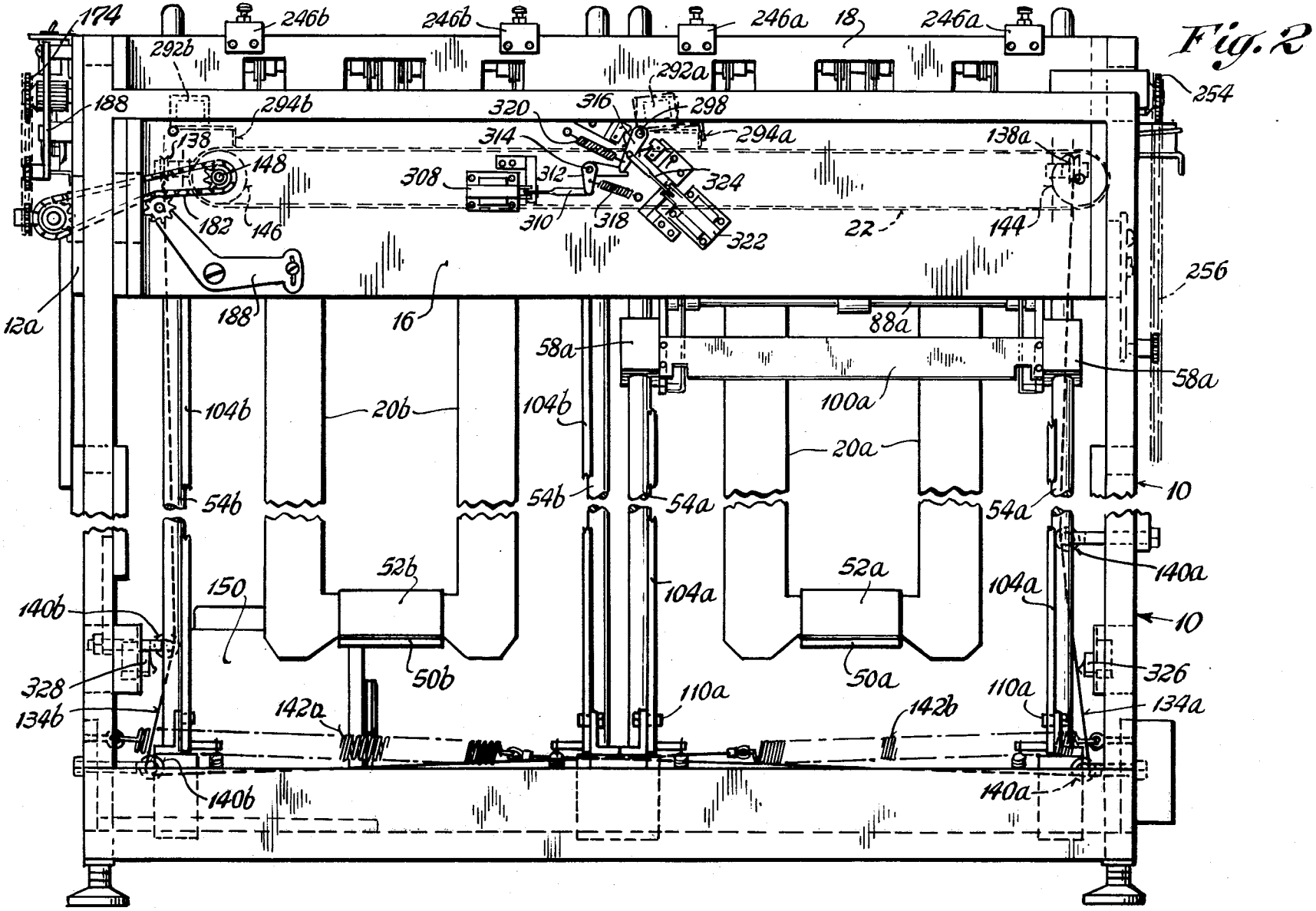
FIG. 2 is a back view of the machine of FIG. 1.

The changeover mechanism will be best understood by reference to FIG. 2. It comprises a changeover solenoid 308, whose armature is connected by a linkage 310 to an L-shaped lever arm 312 mounted on a pivot 314. The horizontal arm of lever 312 is notched to receive the end of a lever 316 which is connected to shaft 298. The lever 312 is urged in a counterclockwise direction about its pivot 314 by means of a coil spring 318. Similarly the end of the lever 316 is urged in a clockwise direction by means of spring 320. A second changeover solenoid 322 has its armature connected to the lever 316 through a linkage 324. The changeover solenoid 322 is controlled by a changeover switch 326 mounted at the base of the main frame 10 in position to be contacted and actuated by the block **58*a* of the tray loading mechanism. The solenoid 308 is actuated by a corresponding switch 328 at the base of main frame 10 which is positioned to be contacted by block 58*b*** of the tray loading mechanism.

ELECTRICAL CIRCUITRY

Figure 15:
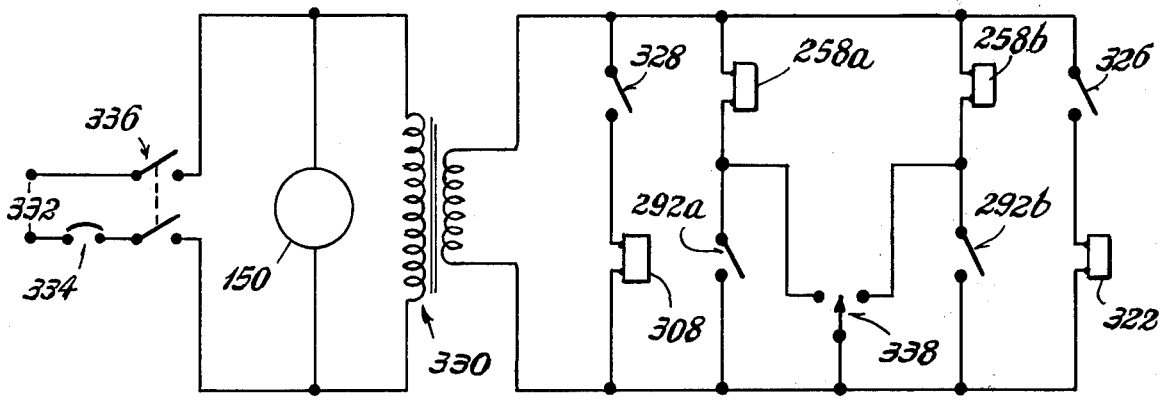
FIG. 15 is a schematic diagram of the electrical circuit of the machine.

A simplified electrical schematic of the machine of this invention is shown in FIG. 15. The motor 150 and a 115V:24V transformer 330 are supplied from a 115V, 60Hz power source 332 through an overload breaker 334 and a DPST switch 336. The secondary winding of the transformer supplies power to the switch-solenoid pairs **328–308, 292*a*–258*a*, 292b–258*b*, 326–322. Each pair is connected in series, the series combinations being in parallel. In addition, a manual three position selector switch 338 permits operator selection of a loading station by selectively energizing either of solenoids 258*a* or 258*b***.

OPERATION

The operational cycle of the mail tray loader described above, will now be explained beginning with the insertion of an empty tray T into one of the loading stations. The tray is inserted when the pair of arms 62 carrying the tray support shelf 118 therebetween are in their uppermost position as shown by the phantom lines in FIG. 5. The tray support rack 20 is also in its raised, substantially vertical, position with the spring clips 46 of the locking arms 44 retained by the locking shaft 32. The empty tray T is slid downwardly on the support rack until its rim is clamped by the spring clips 28.

With the motor 150 running, the transport belts 22 are driven by the drive pulleys 146. They are driven from left to right as viewed in FIG. 1 and are positioned to receive articles such as envelopes E from a postage meter P. The envelopes are fed sequentially onto the moving belts which transport them into the machine and under the springloaded idler rollers 190 shown in FIG. 11, which maintains them in close frictional engagement with the belts 22. Each envelope is transported beneath the plate 198 and under its spring-loaded ball bearings 204 until it contacts the vertical finger 306 of the pivoted sensing arm 302. This stops further travel of the envelope and causes the sensing arm to be rocked in a clockwise direction closing the microswitch 292.

As previously explained, the microswitch 292 is connected to energize the solenoid **258*a* of loading station A as shown in FIGS. 4 and 10. The solenoid, through its linkage 260, actuates the one revolution cam drive clutch 252. The sprocket 254 associated with the clutch is driven continuously from the motor 150 via the shaft 156 and chain 256. Accordingly, actuation of the clutch causes the cam shaft 250*a* to execute one revolution counterclockwise as viewed in FIG. 5**.

Reference should not be made to FIGS. 12–14. FIG. 12 illustrates the mechanism at the beginning of cam rotation. The envelope E is shown in place on the transport belt 22. The bracket 230 is forced down by the cam 266 against the force of spring 234 to maintain tie rod 224 depressed, thereby raising the upper ejector wheels 236 against the force of springs 244. Cams 266 now rotate counterclockwise to the position illustrated in FIG. 13. The spring 234 causes the brackets 230 to slide upwardly along the guide rods 54, thereby releasing the tie rods 224. The springs 244 then press the upper ejector wheels 236 down into engagement with the envelope E, clamping it between lower ejector wheels 218 and upper ejector wheels 236. These wheels are driven continuously by the shafts 166 and 170. The envelope is, accordingly, pinched by these two sets of wheels and ejected from the belts 22 as shown in FIG. 13.

The guide plate 270 extending between the pair of brackets 230 is raised, permitting the envelope to be ejected into the tray (FIG. 5). When in this raised position, the stacker wheels 280 extend below the guide plate 270 and thereby assist in driving the envelope into the tray. As rotation of the shaft 250 and cams 266 continues, the brackets 230 are returned to their original position as shown in FIG. 14 and the presser feet 272, 274 press the envelope downwardly against the tray or the stack of preceding envelopes.

The effect of the downward pressing action will be best understood by reference to FIGS. 5 and 7. As previously explained, the ratchet gear 66 of each of the arms 62 is engaged by pawls 69 on a detent 68 loaded by a spring 70 so that the gear is rotatable in only one direction, namely downwardly along the linear ratchet gear 55 formed in the guide rod 54. Accordingly, as the presser feed 272 repeatedly press down against the growing stack of envelopes E, the arms 62, the tray support shelf 118 and the tray are successively driven downward along the guide rod 54. The tray support rack 20 does not move and the support shelf 118 moves therealong by means of the slots 132 shown in FIG. 8 which engage the edges of the rack. In this manner, the envelopes are successively stacked in the tray, and the tray is simultaneously forced downward along support rack 20 and against the force of counter-weight spring 142 as transmitted by wire 134.

It will be obvious to those skilled in the art that the ratchet gear 66 could be replaced by a simple spring loaded pawl. However, this could cause excessive wear of the linear ratchet gear 55 and require expensive replacement of the guide rods 54. By means of the described construction, wear is limited to the ratchet gear 66 which may be inexpensively replaced.

Eventually, when the tray is substantially filled, the block 58*a* contacts the changeover switch 326 (FIG. 2). During the operation of loading station A, the end of the lever 316 which is secured to shaft 298, is not lodged within the notch in the end of lever 312 as shown but is above this lever. In such a position, the bracket 294 (FIG. 11) is horizontal, with the vertical finger 306 in the path of oncoming mail. Now, however, with the operation of solenoid 322, the linkage 324 is retracted, rotating the lever 316 counterclockwise and into latching engagement with the notched lever 312 as shown in FIG. 2. This rotates the shaft 298, thereby tilting bracket 294 to lift the vertical finger 306 out of the path of oncoming envelopes. These envelopes then proceed to station B, which operates in the same manner to load a waiting empty tray. When the tray in station B is filled, the switch 328 operates the solenoid 308 which retracts linkage 310, rotating lever 312 clockwise to release the lever 316. Bracket 294 returns to the position shown in FIG. 11, whereupon loading station A resumes operation to load a replaced empty tray.

The tray release mechanism is illustrated most clearly in FIGS. 5–9. When the filled tray reaches its lowermost position, the slots 132 in the support shelf 118 run off the end of the support rack 20. This releases the support rack 20 which is then tipped backward as illustrated by the phantom lines of FIG. 4, the spring clips 46 being pulled away from the locking shaft 32 and the bearing block 36 rotating around the splined shaft 26. In this position the loaded tray is easily removed from the support rack by the operator. Thereafter the rack may be returned to the illustrated position.

The tray support shelf is now raised to its original position to receive a new empty tray. This is accomplished by depressing the release pedal 90. As it rotates counterclockwise, as viewed in FIG. 6, the rods 96 contact the drag bars 104, pivoting them outwardly against the force of springs 112 until they reach the position illustrated in FIG. 7. The spring-loaded drag bars 104 then maintain the pedal 90 in its lowered position. As the pedal rotates, so do the attached cams 86. These cams rotate the levers 80 counterclockwise, as viewed, and the wires 76 retract the detent 68 as shown in FIG. 7 against the force of spring 70, thereby permitting the gear 66 to roll freely along the linear gear 55. The tray support shelf assembly is then returned to its raised position. In addition to their function of holding the foot pedal down, the spring-loaded drag bars also serve to slow the return of the assembly which is now empty and under the relatively heavy force of the spring 142 through wire 134. Upon reaching its raised position, the rods 96 drop off the respective knees 106 of the drag bars 104 and the springs 102 rotate the arms 94 to raise pedal 90 to its original position. At the same time, the cams 86 release the rollers 84 permitting the springs 70 to return pawls 69 of detents 68 into engagement with the ratchet gears 66. This loading section is now ready to receive another empty tray and the cycle repeats.

The machine is adjustable for receiving trays of different depths or envelopes of different widths. This adjustment comprises the knob 30 shown in FIG. 3 which, by means of gear train 28, rotates the splined shaft 26. Referring to FIG. 5, it will be seen that, as the shaft rotates, all of the rack gears 40 will be extended from or withdrawn into the support cylinders 38, thereby positioning the tray support racks as required. The tray support shelf must also be repositioned, and this is accomplished by loosening the wing nut shown in FIG. 8 holding screw 124, sliding post 122 to the proper position in slot 116 (FIG. 5), and re-tightening so that the post 122 supports the lip 126 of the support shelf in the proper location.

It is believed that the many advantages of this invention will now be apparent to those skilled in the art. It will also be apparent that a number of variations and modifications may be made in this invention without departing from its spirit and scope. For example, although disclosed as a mail tray loader, the inventive concept may be employed for loading many types of articles into containers. Also, any number of loading stations may be included. Accordingly, the foregoing description is to be construed as illustrative only, rather than limiting. This invention is limited only by the scope of the following claims.

What is claimed is:

1. A container loading system for transporting and loading articles into containers, said system comprising:

means defining a feed path for transporting articles in seriatim;

means for transporting said articles along said feed path;

a first removable loading container having an open top disposed adjacent and substantially perpendicular to said feed path for receiving said articles, said first container being oriented at an incline approaching the vertical with its open top facing the feed path, said first container having signal means for providing a full load signal when said first container is full;

a second removable loading container having an open top for receiving said articles, said second loading container disposed adjacent and substantially perpendicular to said feed path downstream from said first loading container, said second container being oriented at an incline approaching the vertical with its open top facing the feed path;

means defining a first loading station disposed along said feed path for receiving said transported articles and ejecting the articles to said first loading container, said first loading station comprising a first limiting means disposed along said feed path for stopping each article as it is received at said first loading station, and a first ejecting means for ejecting each stopped article at said first loading station to said first container;

means defining a second loading station disposed along said feed path downstream of said first loading station for receiving transported articles and ejecting the articles to said second loading container when said articles are allowed to pass by said first loading station, said second loading station comprising a second limiting means disposed along said feed path for stopping each article as it is received at said second loading station, and a second ejecting means for ejecting each stopped article at said second loading station to said second loading container;

switching means operatively connected to said first limiting means and said signal means for disabling the first limiting means from stopping received articles in response to said full load signal, whereby the articles are allowed to pass by the first loading station and are transported to said second loading station when said first loading container is full; and means for lowering each of said containers to sequentially receive articles that are ejected from said transporting means, said containers each being movable until full of said articles, whereby the signal means is activated to provide said signal.

2. The machine of claim 1 wherein said transporting means comprises an endless belt.

3. The machine of claim 2 wherein said transporting means comprises a plurality of rollers bearing against said belt and against articles transported thereon.

4. The machine of claim 1 wherein said supporting means comprises: a support rack; and means for rotating said rack to a container unloading position.

5. The machine of claim 4 wherein said rotating means comprises: a substantially horizontal shaft mounted on said frame; and means for securing said rack to said shaft for rotation thereabout.

6. The machine of claim 5 wherein said securing means comprises: at least two rods secured to said support rack; bearing means associated with each of said rods and rotatable about said shaft; and means for adjustably interconnecting each of said rods with its associated bearing means.

7. The machine of claim 6 wherein said interconnecting means comprises: a rack gear formed on each of said rods; gear teeth carried by said shaft in mesh with each of said rack gears; and means for rotating said shaft to advance or retract each of said rods relative thereto.

8. The machine of claim 7 wherein said shaft is splined.

9. The machine of claim 1 wherein said ejecting means comprises: means for stopping each of said articles at said loading station; and ejector wheel; means for normally retaining said ejector wheel in a removed position from each of said articles; and means for advancing said ejector wheel against a stopped article to eject said article into said container.

10. The machine of claim 9 wherein said retaining means comprises: a pivoted bracket supporting said ejector wheel; and means for actuating said bracket to pivot it between a first, wheel removed, positioned and a second, ejecting, position.

11. The machine of claim 10 wherein said actuating means is linearly movable.

12. The machine of claim 11 wherein said advancing means is a cam positioned to bear against, and linearly move, said actuating means.

13. The machine of claim 9 wherein said retaining means comprises: a plurality of aligned wheel brackets pivotally mounted along a common axis, each carrying an ejector wheel; and means for simultaneously actuating said wheel brackets to pivot them between a first, wheel removed, position and a second, ejecting, position.

14. The machine of claim 13 wherein said actuating means comprises: a tie rod interconnecting all of said wheel brackets and parallel to said common axis; spring means tending to pivot said wheel brackets to their second position; and a pair of spaced, linearly movable, actuator brackets, each positioned to move between a location in contact with said tie rod maintaining said wheel brackets in their wheel removed positions and a release location removed from said tie rod permitting said wheel brackets to pivot to their second positions.

15. The machine of claim 14 wherein said advancing means comprises: a pair of spaced cams rotatable about a common axis, each cam being positioned to drive a different one of said actuator brackets between its contact and release locations; and means for substantially simultaneously rotating said cams.

16. The machine of claim 1 wherein said sensing means comprises: a switch connected to actuate said ejecting means; and means positioned to be impacted by each of said articles for actuating said switch.

17. The machine of claim 16 wherein said switch actuating means comprises: an arm mounted to pivot about an axis substantially perpendicular to the transport path of said articles and including a first finger within said path and a second finger adjacent the actuating mechanism of said switch.

18. The machine of claim 1 wherein said container lowering means comprises: a pair of spaced, parallel, vertically inclined guide rods; a slide member mounted on each of said guide rods for movement therealong; an arm secured to each of said slide members and extending therefrom, said arms being in aligned, parallel relationship; means associated with each of said slide member-arm combinations for controlling the movement of said slide member on its associated guide rod; a container support shelf extending between said arms for receiving a container resting upon said container supporting means; and means for repetitively depressing said container support shelf to incrementally lower said shelf and supported container along said container supporting means.

19. The machine of claim 18 wherein each of said guide rods defines gear teeth therealong and wherein each of said movement controlling means comprises a ratchet normally permitting downward movement and preventing upward movement along said guide rods.

20. The machine of claim 19 wherein each of said movement controlling means comprises means for selectively disengaging said ratchet to permit upward movement.

21. The machine of claim 20 wherein both of said disengaging means are operable by a single control.

22. The machine of claim 18 wherein said depressing means is disposed to bear downwardly against a stack of articles ejected into said container.

23. The container loading system of claim 1, wherein the second loading container comprises a signal means for providing a full load signal when said second container is full, and further wherein said full load signal from said second loading container is operatively coupled to said first limiting means, whereby the articles are prevented from passing by the first loading station when said second loading container is full.

24. The container loading system of claim 1, wherein said articles are envelopes.

25. The container loading system of claim 1, wherein the means defining said feed path is for transporting said articles in essentially a straight line.

26. The container loading system of claim 25, wherein each of the ejecting means ejects the articles at essentially a right angle from said feed path.

* * * * *